US010916255B2

(12) United States Patent
Setiawan et al.

(10) Patent No.: US 10,916,255 B2
(45) Date of Patent: Feb. 9, 2021

(54) APPARATUSES AND METHODS FOR ENCODING AND DECODING A MULTICHANNEL AUDIO SIGNAL

(71) Applicant: HUAWEI TECHNOLOGIES DUESSELDORF GMBH, Duesseldorf (DE)

(72) Inventors: Panji Setiawan, Munich (DE); Milos Markovic, Munich (DE)

(73) Assignee: Huawei Technologies Duesseldorf GmbH, Duesseldorf (DE)

( * ) Notice: Subject to any disclaimer, the term of this patent is extended or adjusted under 35 U.S.C. 154(b) by 34 days.

(21) Appl. No.: 16/229,921

(22) Filed: Dec. 21, 2018

(65) Prior Publication Data

US 2019/0147892 A1 May 16, 2019

Related U.S. Application Data

(63) Continuation of application No. PCT/EP2016/065395, filed on Jun. 30, 2016.

(51) Int. Cl.
*G10L 19/008* (2013.01)

(52) U.S. Cl.
CPC ..... *G10L 19/008* (2013.01)

(58) Field of Classification Search
USPC ..... 704/500–504
See application file for complete search history.

(56) References Cited

U.S. PATENT DOCUMENTS

2007/0297499 A1* 12/2007 de Victoria ..... H04L 25/03133 375/232
2015/0154971 A1* 6/2015 Boehm ..... G10L 19/038 704/500
2015/0221313 A1* 8/2015 Purnhagen ..... G10L 19/22 704/500
2016/0148618 A1* 5/2016 Huang ..... G10L 19/005 381/2
2016/0155448 A1* 6/2016 Purnhagen ..... G10L 19/008 704/204

OTHER PUBLICATIONS

Torres-Guijarro et al., "Multichannel Audio Decorrelation for Coding," Proc. of the 6th Int. Conference on Digital Audio Effects(DAFX-03), London, UK, XP055339531 (2003).

(Continued)

*Primary Examiner* — Leonard Saint Cyr
(74) *Attorney, Agent, or Firm* — Leydig, Voit & Mayer, Ltd.

(57) ABSTRACT

An input audio signal comprises a plurality of input audio channels. A KLT-based pre-processor transforms the plurality of input audio channels into a plurality of eigenchannels and provides metadata associated with the plurality of eigenchannels. Each eigenchannel is associated with an eigenvalue and an eigenvector. The metadata allows reconstructing the plurality of input audio channels on the basis of the plurality of eigenchannels. A selector selects a subset of the plurality of eigenvectors corresponding to a plurality of selected eigenchannels on the basis of a geometric mean of the eigenvalues. An eigenchannel encoder encodes the plurality of selected eigenchannels. A metadata encoder encodes the metadata.

23 Claims, 9 Drawing Sheets

(56) References Cited

OTHER PUBLICATIONS

Valjamae "A feasibility study regarding implementation of holographic audio rendering techniques over broadcast networks," XP002529548 (Apr. 15, 2003).
Yang et al., "An Exploration of Karhunen-Loeve Transtomi for Muitichannel Audio Coding," XP055339543 (2000).
Yang et al., "High-Fidelity Multichannel Audio Coding With Karhunen-Loève Transform," IEEE Transactions on Speech and Audio Processing, vol. 11, No. 4, pp. 365-380, Institute of Electrical and Electronics Engineers, New York, New York (Jul. 2003).
"Frequently asked Questions about Dolby Digital," Dolby, pp. 1-16 (2000).
Valin et al., "High-Quality, Low-Delay Music Coding in the Opus Codec," 135th AES Convention, New York, USA, Audio Engineering Society (Oct. 17-20, 2013).
Neuendorf et al., "The ISO/MPEG Unified Speech and Audio Coding Standard—Consistent High Quality for all Content Types and at all Bit Rates," J. Audio Eng. Soc., vol. 61, No. 12, pp. 956-977 (Dec. 2013).
"Figures" 3GPP TS 26.445 V13.1.0, pp. 1-15, 3rd Generation Partnership Project, Valbonne, France (Mar. 2016).
"3rd Generation Partnership Project; Technical Specification Group Services and System Aspects; Codec for Enhanced Voice Services (EVS); Detailed Algorithmic Description(Release 13)," 3GPP TS 26.445 V13.1.0, pp. 1-655, 3rd Generation Partnership Project, Valbonne, France (Mar. 2016).
"Multichannel sound technology in home and broadcasting applications," Report ITU-R BS. 2159-4, BS Series, Broadcasting service(sound), International Telecommunication Union, Geneva, Switzerland (May 2012).
"Em32 Eigenmike® microphone array release notes (v18.0), Notes for setting up and using the mh acoustics em32 Eigenmike® microphone array," mh acoustics (Jun. 18, 2014).
Herre et al., "MPEG-H 3D Audio—The New Standard for Coding of Immersive Spatial Audio," IEEE Journal of Selected Topics in Signal Processing, vol. 9, No. 5, pp. 770-779, Institute of Electrical and Electronics Engineers, New York, New York (Aug. 2015).
"Dolby® Atmos® Next-Generation Audio for Cinema," Issue 3, Dolby (2014).

* cited by examiner

APPARATUSES AND METHODS FOR ENCODING AND DECODING A MULTICHANNEL AUDIO SIGNAL

CROSS-REFERENCE TO RELATED APPLICATIONS

This application is a continuation of International Application No. PCT/EP2016/065395, filed on Jun. 30, 2016, the disclosure of which is hereby incorporated by reference in its entirety.

TECHNICAL FIELD

The invention relates to the field of audio signal processing. More specifically, the invention relates to apparatuses and methods for encoding and decoding a multichannel audio signal on the basis of the Karhunen-Loève Transform (KLT).

BACKGROUND

In the field of multichannel spatial audio coding the two following challenges will likely become more prominent in the future: (i) processing an input audio signal with an arbitrary number of recorded audio channels and (ii) handling a plurality of arbitrarily placed microphones, in particular with respect to angles. One reason for this development is the current trend of providing more and more advanced audio recording devices, such as the Eigenmike. Moreover, another current trend is the use of various conventional recording devices at the same time for producing a multichannel audio signal. Thus, there is a need for a generic audio coding scheme that is able to meet the challenges mentioned above.

Currently, activities in multichannel audio coding for streaming and storage purposes are gaining popularity due to the many possible new applications in the field of immersive sound, such as applications for cinemas, virtual reality, telepresence and the like. Exemplary current multichannel audio codecs are Dolby Atmos using a multichannel object based coding, MPEG-H 3D Audio, which incorporates channel objects and Ambisonics-based coding. These current existing multichannel codecs, however, are still limited to some specific numbers of audio channel, such as 5.1, 7.1 or 22.2 channels, as required by industrial standards, such as ITU-R BS.2159-4.

Thus, there is a need for an improved generic audio coding scheme allowing, in particular to process audio signals with an arbitrary number of audio channels as well as multichannel audio signals acquired on the basis of arbitrary arrangements of the audio recording devices.

SUMMARY

It is an object of embodiments of the invention to provide improved apparatuses and methods for encoding and decoding a multichannel audio signal.

The foregoing and other objects are achieved by the subject matter of the independent claims. Further implementation forms are apparent from the dependent claims, the description and the figures.

According to a first aspect the invention relates to an apparatus for encoding an input audio signal, wherein the input audio signal is a multichannel audio signal, i.e. comprises a plurality of input audio channels. The apparatus comprises a pre-processor based on the Karhunen-Loève transformation (KLT), i.e. a KLT-based pre-processor. The KLT-based pre-processor is configured to transform the plurality of input audio channels into a plurality of eigenchannels (also referred to as transform coefficients) and to provide metadata associated with the plurality of eigenchannels, wherein each eigenchannel is associated with an eigenvalue and an eigenvector and wherein the metadata allows reconstructing the plurality of input audio channels on the basis of the plurality of eigenchannels. The apparatus further comprises a selector configured to select a subset of the plurality of eigenvectors corresponding to a plurality of selected eigenchannels on the basis of a geometric mean of the eigenvalues and an eigenchannel encoder configured to encode the plurality of selected eigenchannels. Moreover, the apparatus may comprise a metadata encoder configured to encode the metadata. The selector can be implemented as part of the KLT-based pre-processor.

In a first implementation form of the apparatus according to the first aspect as such the number P of selected eigenchannels is less than or equal to the number Q of input audio channels.

In a second implementation form of the apparatus according to the first aspect as such or the first implementation form thereof, the metadata comprises one or more of the following: a covariance matrix associated with the plurality of input audio channels and eigenvectors of a covariance matrix associated with the plurality of input audio channels.

In a third implementation form of the apparatus according to the first aspect as such or the first or second implementation form thereof, the selector is configured to select a subset of the plurality of eigenvectors by selecting those eigenvectors that have eigenvalues that are greater than the geometrical mean of the eigenvalues that are greater than a first threshold value. In an implementation form the first threshold value is zero or approximately zero.

In a fourth implementation form of the apparatus according to the third implementation form of the first aspect, the selector is configured to select a subset of the plurality of eigenvectors by selecting only the eigenvector with the largest eigenvalue if the absolute difference between the geometric mean of the eigenvalues that are greater than the first threshold value and the arithmetic mean of the eigenvalues that are greater than the first threshold value is less than a second threshold value.

In a fifth implementation form of the apparatus according to the fourth implementation form of the first aspect, the input audio signal comprises a plurality of frequency bands and the selector is configured to allow the second threshold value to be different for different frequency bands. I.e., each of the frequency bands can have its own threshold value. In an implementation form each frequency band can be divided into a plurality of frequency bins, wherein the second threshold value can be different for different frequency bins.

In a sixth implementation form of the apparatus according to the first aspect as such or any one of the first to fifth implementation form thereof, the selector is further configured to normalize the eigenvalues that are greater than the first threshold value on the basis of the smallest eigenvalue that is greater than the first threshold value.

In a seventh implementation form of the apparatus according to the first aspect as such or any one of the first to sixth implementation form thereof, the apparatus further comprises a control unit configured to choose on the basis of a pre-defined bitrate threshold between a first encoding mode and a second encoding mode, wherein in the first encoding mode the input audio signal is encoded by encoding the plurality of selected eigenchannels and the metadata and wherein in the second encoding mode the input audio signal is encoded by encoding the plurality of input audio channels.

In an eighth implementation form of the apparatus according to the seventh implementation form of the first aspect, the control unit is configured to estimate a bitrate associated with encoding the plurality of selected eigenchannels and the metadata and to choose the first encoding mode if the estimated bitrate is less than the pre-defined bitrate threshold.

According to a second aspect the invention relates to an apparatus for decoding an input audio signal, wherein the input audio signal comprises a plurality of encoded eigenchannels and encoded metadata. The apparatus comprises an eigenchannel decoder configured to decode the plurality of encoded eigenchannels, wherein each eigenchannel is associated with an eigenvalue and an eigenvector, a metadata decoder configured to decode the encoded metadata, a selector configured to select a subset of the plurality of eigenvectors on the basis of a geometric mean of the eigenvalues, and a KLT-based post-processor configured to transform the decoded eigenchannels into a plurality of output audio channels on the basis of the selected eigenvectors.

According to a first implementation form of the apparatus according to the second aspect as such, the selector is configured to select a subset of the plurality of eigenvectors by selecting the eigenvectors that have eigenvalues that are greater than the geometrical mean of the eigenvalues that are greater than a first threshold value.

Further implementation forms of the decoding apparatus according to the second aspect of the invention follow directly from the corresponding implementation forms of the encoding apparatus according to the first aspect of the invention.

According to a third aspect the invention relates to a method for encoding an input audio signal, wherein the input audio signal comprises a plurality of input audio channels. The method comprises the steps of transforming the plurality of input audio channels into a plurality of eigenchannels and providing metadata associated with the plurality of eigenchannels, wherein each eigenchannel is associated with an eigenvalue and an eigenvector and wherein the metadata allows reconstructing the plurality of input audio channels on the basis of the plurality of eigenchannels, selecting a subset of the plurality of eigenchannels on the basis of a geometric mean of the eigenvalues, encoding the plurality of selected eigenchannels, and encoding the metadata.

The encoding method according to the third aspect of the invention can be performed by the encoding apparatus according to the first aspect of the invention. Further features of the encoding method according to the third aspect of the invention result directly from the functionality of the encoding apparatus according to the first aspect of the invention and its different implementation forms.

According to a fourth aspect the invention relates to a method for decoding an input audio signal, wherein the input audio signal comprises a plurality of encoded eigenchannels and encoded metadata. The method comprises the steps of decoding the plurality of encoded eigenchannels, wherein each eigenchannel is associated with an eigenvalue and an eigenvector, decoding the encoded metadata, selecting a subset of the plurality of eigenvectors on the basis of a geometric mean of the eigenvalues, and transforming the decoded eigenchannels into a plurality of output audio channels on the basis of the selected eigenvectors.

The decoding method according to the fourth aspect of the invention can be performed by the decoding apparatus according to the second aspect of the invention. Further features of the decoding method according to the fourth aspect of the invention result directly from the functionality of the decoding apparatus according to the second aspect of the invention and its different implementation forms.

According to a fifth aspect the invention relates to a computer program comprising program code for performing the encoding method according to the third aspect of the invention or the decoding method according to the fourth aspect of the invention when executed on a computer.

The invention can be implemented in hardware and/or software.

BRIEF DESCRIPTION OF THE DRAWINGS

Further embodiments of the invention will be described with respect to the following figures, wherein.

In the various figures, identical reference signs will be used for identical or at least functionally equivalent features.

DETAILED DESCRIPTION OF EMBODIMENTS

In the following description, reference is made to the accompanying drawings, which form part of the disclosure, and in which are shown, by way of illustration, specific aspects in which the invention may be placed. It will be appreciated that the invention may be placed in other aspects and that structural or logical changes may be made without departing from the scope of the invention. The following detailed description, therefore, is not to be taken in a limiting sense, as the scope of the invention is defined by the appended claims.

For instance, it will be appreciated that a disclosure in connection with a described method will generally also hold true for a corresponding device or system configured to perform the method and vice versa. For example, if a specific method step is described, a corresponding device may include a unit to perform the described method step, even if such unit is not explicitly described or illustrated in the figures.

Moreover, in the following detailed description as well as in the claims, embodiments with functional blocks or processing units are described, which are connected with each other or exchange signals. It will be appreciated that the invention also covers embodiments which include additional functional blocks or processing units that are arranged between the functional blocks or processing units of the embodiments described below.

Finally, it is understood that the features of the various exemplary aspects described herein may be combined with each other, unless specifically noted otherwise.

Figure 1:
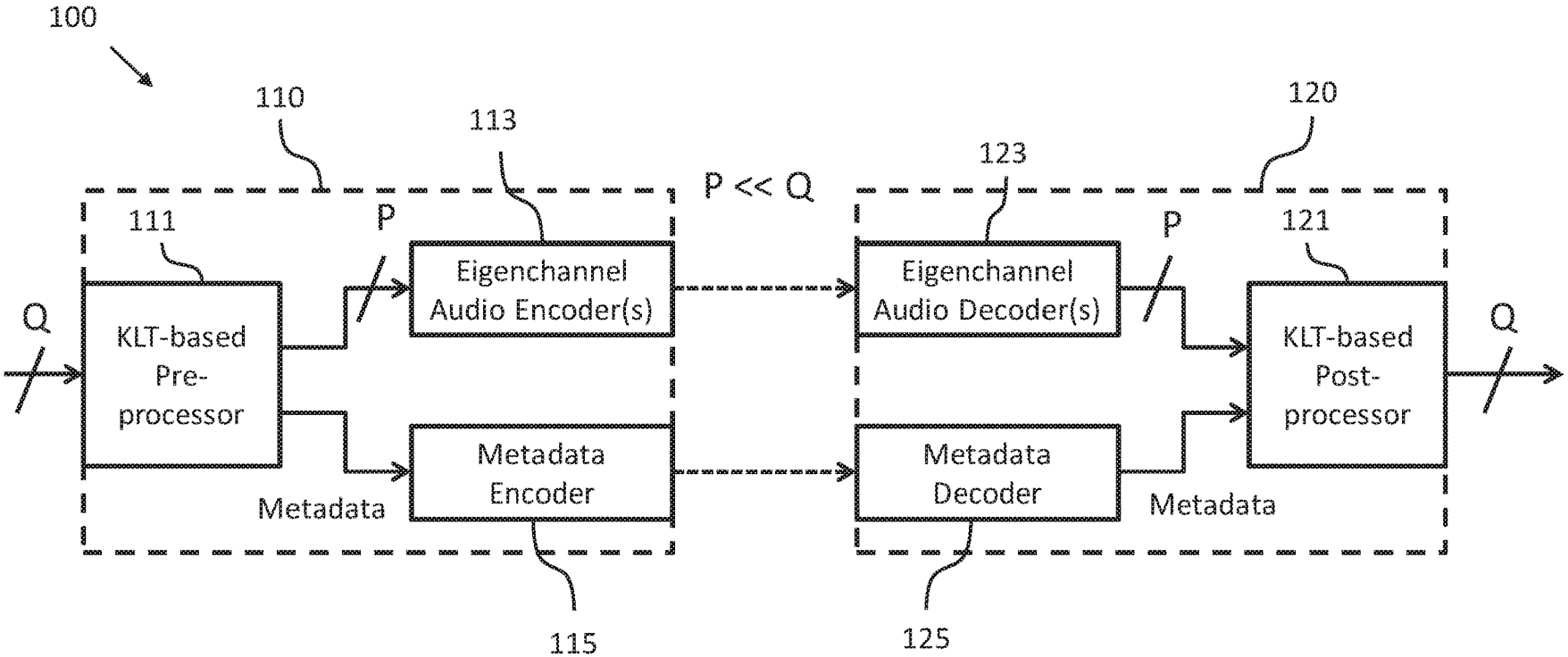
FIG. 1 shows a schematic diagram of an audio coding system comprising an apparatus for encoding an audio signal according to an embodiment and an apparatus for decoding the encoded audio signal according to an embodiment.

FIG. 1 shows a schematic diagram of an audio coding system 100 comprising an apparatus 110 for encoding a multichannel audio signal according to an embodiment and an apparatus 120 for decoding the encoded multichannel audio signal according to an embodiment. As will be described in more detail further below, the encoding apparatus 110 and the decoding apparatus 120 implement a KLT-based audio coding approach. Further details about this approach are described in Yang et al., "High-Fidelity Multichannel Audio Coding with Karhunen-Loève Transform", IEEE Trans. on Speech and Audio Proc., Vol. 11, No. 4, July 2003, which is hereby incorporated by reference in its entirety.

The apparatus 110 for encoding an input audio signal consisting of Q input audio channels comprises a KLT-based pre-processor 111 configured to transform the Q input audio channels into a P eigenchannels and to provide metadata associated with the P eigenchannels, which allows reconstructing the Q input audio channels on the basis of the P eigenchannels. Each eigenchannel is associated with an eigenvalue and an eigenvector. In an embodiment, the metadata can comprise the non-redundant elements of a covariance matrix associated with the Q input audio channels and/or the eigenvectors of the covariance matrix associated with the Q input audio channels.

The apparatus 110 further comprises a selector 114, embodiments of which will be described in more detail under reference to FIGS. 2*a* and 4*a* further below. The selector 114 is configured to select a subset of the Q eigenchannels on the basis of a geometric mean of the eigenvalues in order to obtain P selected eigenchannels with P less than or equal to Q by selecting P eigenvectors.

Moreover, the apparatus 110 comprises an eigenchannel encoder 113 configured to encode the P eigenchannels selected by the selector 114 on the basis of a geometric mean of the eigenvalues as well as a metadata encoder 115 configured to encode the metadata provided by the KLT-based pre-processor 111.

As can be taken from FIG. 1, the apparatus 120 for decoding the encoded multichannel audio signal according comprises components corresponding to the components of the encoding apparatus 110 described above. More specifically, the decoding apparatus 120 comprises an eigenchannel decoder 123 for decoding the P selected eigenchannels encoded by the eigenchannel encoder 113, a metadata decoder 125 for decoding the metadata encoded by the metadata encoder 115 and a KLT-based post-processor 121, which will be described in more detail in the context of FIGS. 2*b* and 4*b* further below.

Figure 2A:
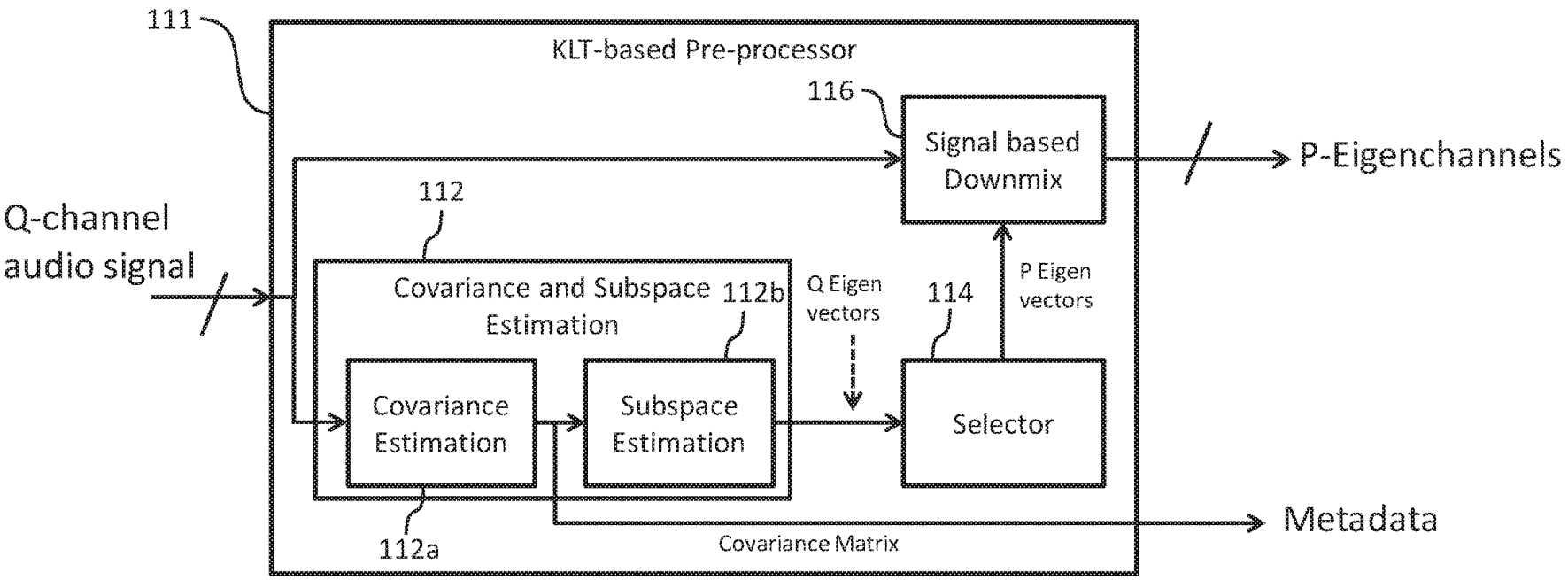
FIG. 2*a* shows a schematic diagram of a KLT-based pre-processor of an apparatus for encoding an audio signal according to an embodiment.

FIG. 2*a* shows a schematic diagram of the KLT-based pre-processor 111 of the encoding apparatus 110 shown in FIG. 1 according to an embodiment. The KLT-based pre-processor 111 comprises a unit 112 for covariance and subspace estimation including a covariance estimation unit 112*a* configured to determine the covariance matrix associated with the Q input audio channels and a subspace estimation unit 112*b* configured to determine the plurality of eigenvectors.

The unit 112 for covariance and subspace estimation provides the Q eigenvectors determined on the basis of the Q input audio channels to the selector 114. As already described above, the selector 114 is configured to select P selected eigenvectors from the Q eigenvectors on the basis of a geometric mean of the eigenvalues. A process for selecting the P eigenvectors on the basis of a geometric mean of the eigenvalues, which in an embodiment is implemented in the selector 114, will be described in the context of FIG. 3 further below. Furthermore, the KLT-bases pre-processor 111 shown in FIG. 2*a* comprises a signal based downmix unit 116 configured to provide the P eigenchannels. In an embodiment, these P eigenchannels correspond to the P eigenvectors selected by the selector 114.

Figure 2B:
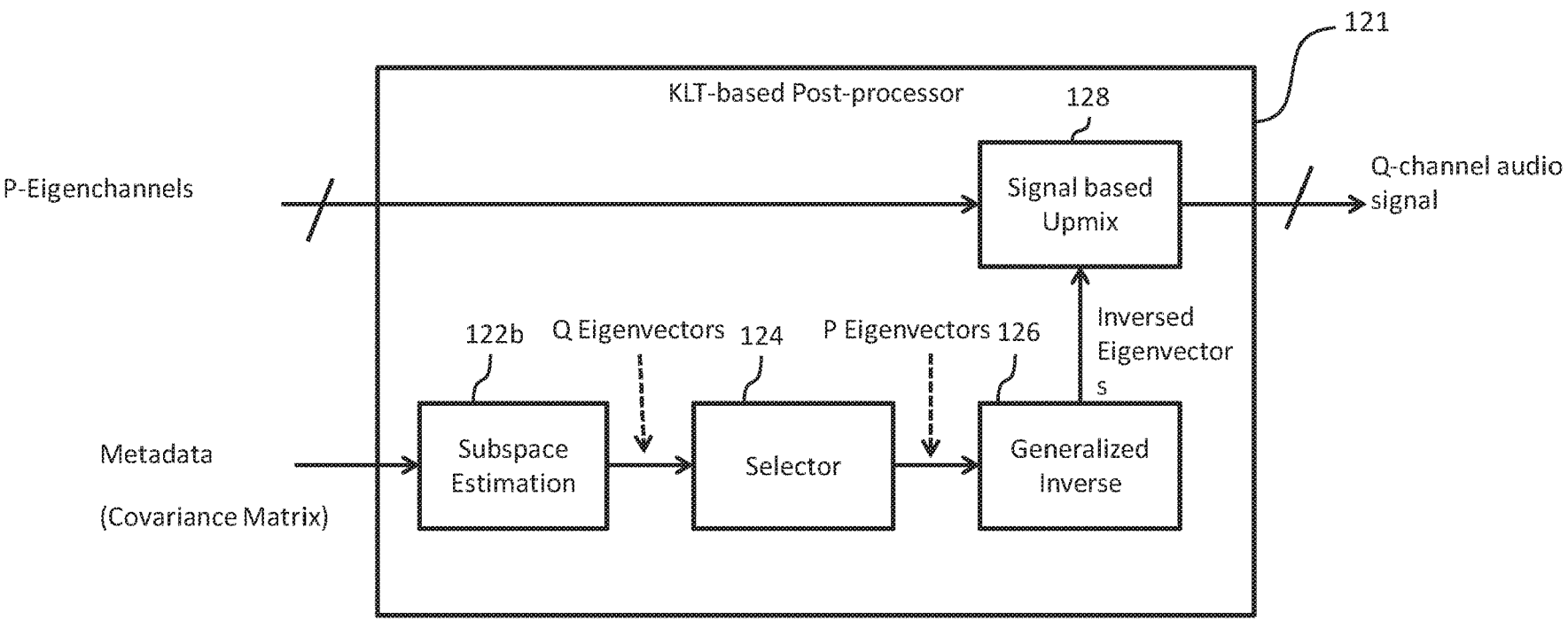
FIG. 2*b* shows a schematic diagram of a KLT-based post-processor of an apparatus for decoding an audio signal according to an embodiment.

FIG. 2*b* shows a schematic diagram of the KLT-based post-processor 121 of the decoding apparatus 120 shown in FIG. 1. Also in this case, the KLT-based post-processor 121 shown in FIG. 2*b* comprises components corresponding to the components of the KLT-based pre-processor 111 shown in FIG. 2*a* and described above. More specifically, the KLT-based post processor 121 comprises a subspace estimation unit 122*b* configured to estimate the Q eigenvectors on the basis of the decoded metadata, the selector 124 configured to select P eigenvectors from the Q eigenvectors on the basis of a geometric mean of the eigenvalues, a unit 126 for determining the generalized inverse of the P selected eigenvectors and a signal based upmix unit 128 configured to provide the decoded Q channels on the basis of the P eigenchannels and inversed eigenvectors provided by the unit 126.

Figure 3:
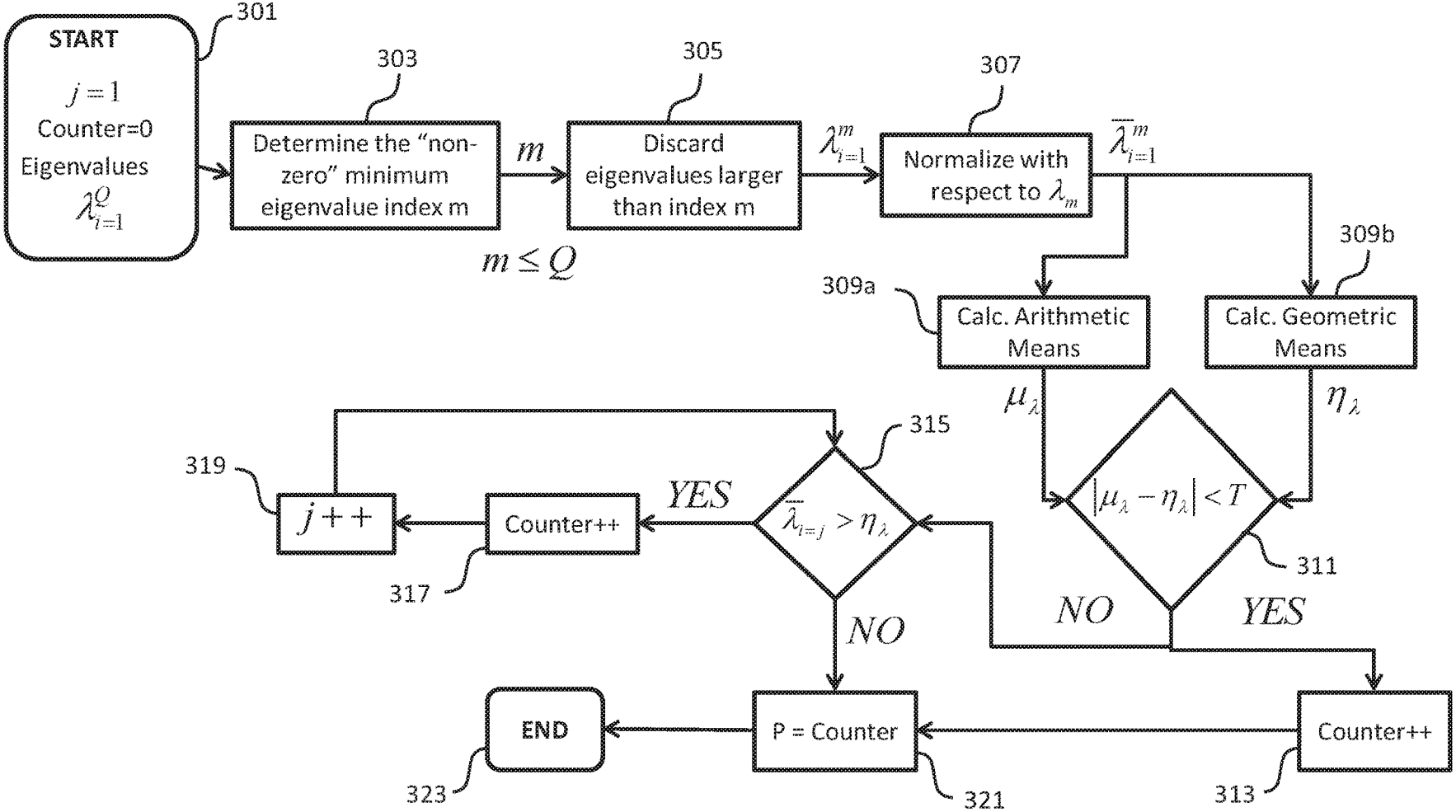
FIG. 3 shows a schematic flow diagram illustrating the process of selecting a subset of a plurality of eigenvectors according to an embodiment.

FIG. 3 shows a schematic flow diagram illustrating an embodiment of the process of selecting the subset of P eigenvectors from the original Q eigenvectors, which could be implemented in the selector 114 of the encoding apparatus 110 and/or the selector 124 of the decoding apparatus 120. At the beginning 301 of the process an index and a counter is initialized and it is assumed that the Q eigenvalues are arranged in decreasing order.

In a step 303 the selector 114, 124 determines the minimum "non-zero" eigenvalue and sets the index m of this eigenvalue as the maximum index (m<=Q) and as the maximum dimension of eigenvalues. In an embodiment, the selector 114, 124 can be configured to determine the minimum "non-zero" eigenvalue by determining the smallest eigenvalue that is greater than or equal to a first positive non-zero threshold value T1.

In a step 305 the selector 114, 124 discards the eigenvalues that have indices larger than m and which therefore are less than the first threshold value T1, i.e. zero or close to zero.

In a step 307 the selector 114, 124 can normalize the remaining m eigenvalues on the basis of the smallest remaining eigenvalue $\lambda_m$ resulting in m normalized eigenvalues $\bar{\lambda}_{i=1}^{m}$.

In a step 309*a* and a step 309*b* the selector 114, 124 can determine the arithmetic mean $\mu_\lambda$ and the geometric mean $\eta_\lambda$ of the m normalized eigenvalues, respectively.

In a step 311 the selector 114, 124 checks whether the absolute difference between the arithmetic mean $\mu_\lambda$ and the geometric mean $\eta_\lambda$ of the m normalized eigenvalues is less than a second threshold value T. If this is the case the selector 114, 124 will select one eigenvalue (and the corresponding eigenvector), namely the largest eigenvalue (see steps 313, 321 and 323). This makes sure that in case the eigenvalues are very similar at least one eigenvalue (and the corresponding eigenvector and eigenchannel) is selected by the selector 114, 124.

In case the selector 114, 124 determines in step 311 that the absolute difference between the arithmetic mean $\mu_\lambda$ and the geometric mean $\eta_\lambda$ of the m normalized eigenvalues is not less than the second threshold value T (which implies that the eigenvalues are significantly different), the selector 114, 124 enters the loop consisting of the steps 315, 317 and 319. The loop starts from the largest normalized eigenvalue $\bar{\lambda}_1$ and the selector 114, 124 checks in step 315 if the largest normalized eigenvalue $\bar{\lambda}_1$ is greater than the geometric mean $\eta_\lambda$. If this is the case, the selector 114, 124 will iterate this step for the subsequent normalized eigenvalues as long as the respective normalized eigenvalue is larger than the geometric mean $\eta_\lambda$. In doing so, the selector 114, 124 essentially selects the P eigenvectors by selecting those eigenvectors that have normalized eigenvalues that are greater than the geometrical mean $\eta_\lambda$ of the m normalized eigenvalues, i.e. the eigenvalues that are greater than the first threshold value T1.

In an embodiment, the selection process shown in FIG. 3 can be implemented in the selector 114, 124 for different frequency bands or bins. In such an embodiment, the first threshold value T1 and the second threshold value T can be different for different frequency bands or bins. For instance, the values T1 and T can be different for each bin/band taking into account some perceptually important criteria (e.g., lower bins/bands may have higher values). In an embodiment, the selector 114, 124 can be configured to dynamically adjust the values T1 and T, for instance, depending on the dynamic range of the eigenvalues.

Figure 4A:
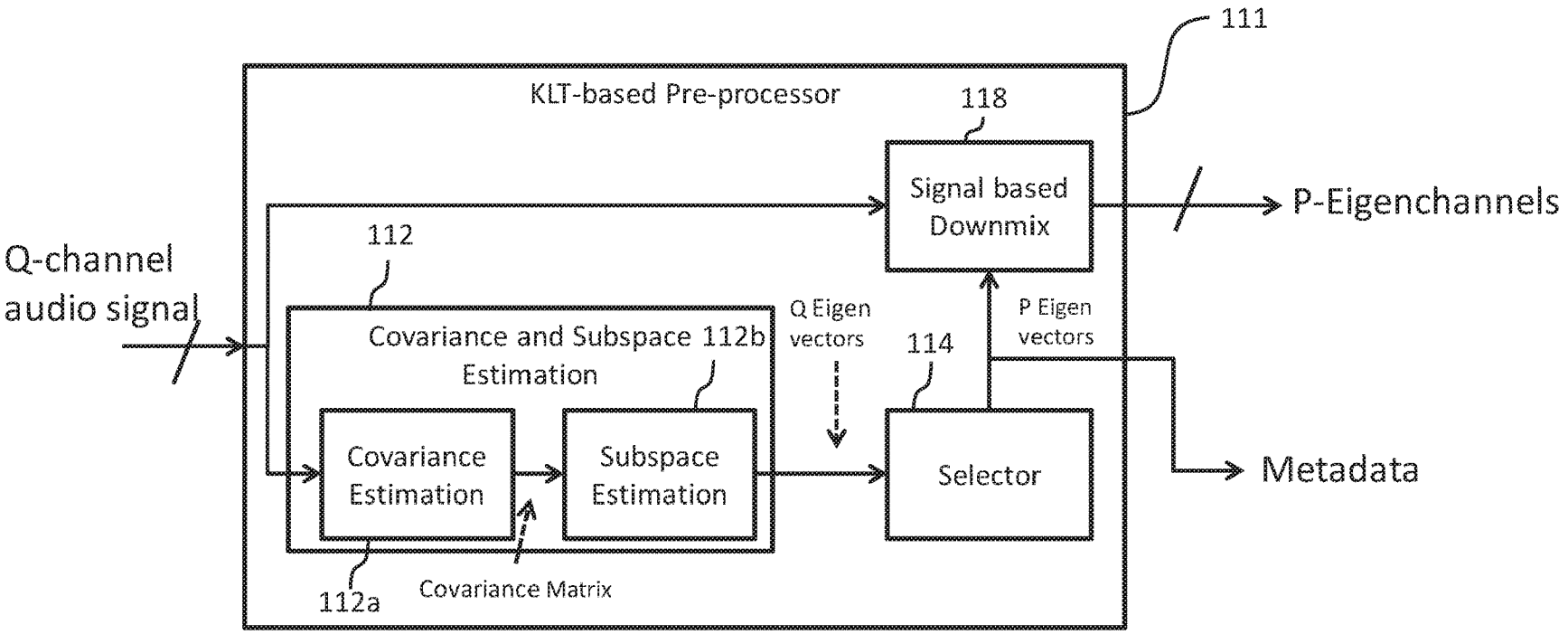
FIG. 4*a* shows a schematic diagram of a KLT-based pre-processor of an apparatus for encoding an audio signal according to an embodiment.
Figure 4B:
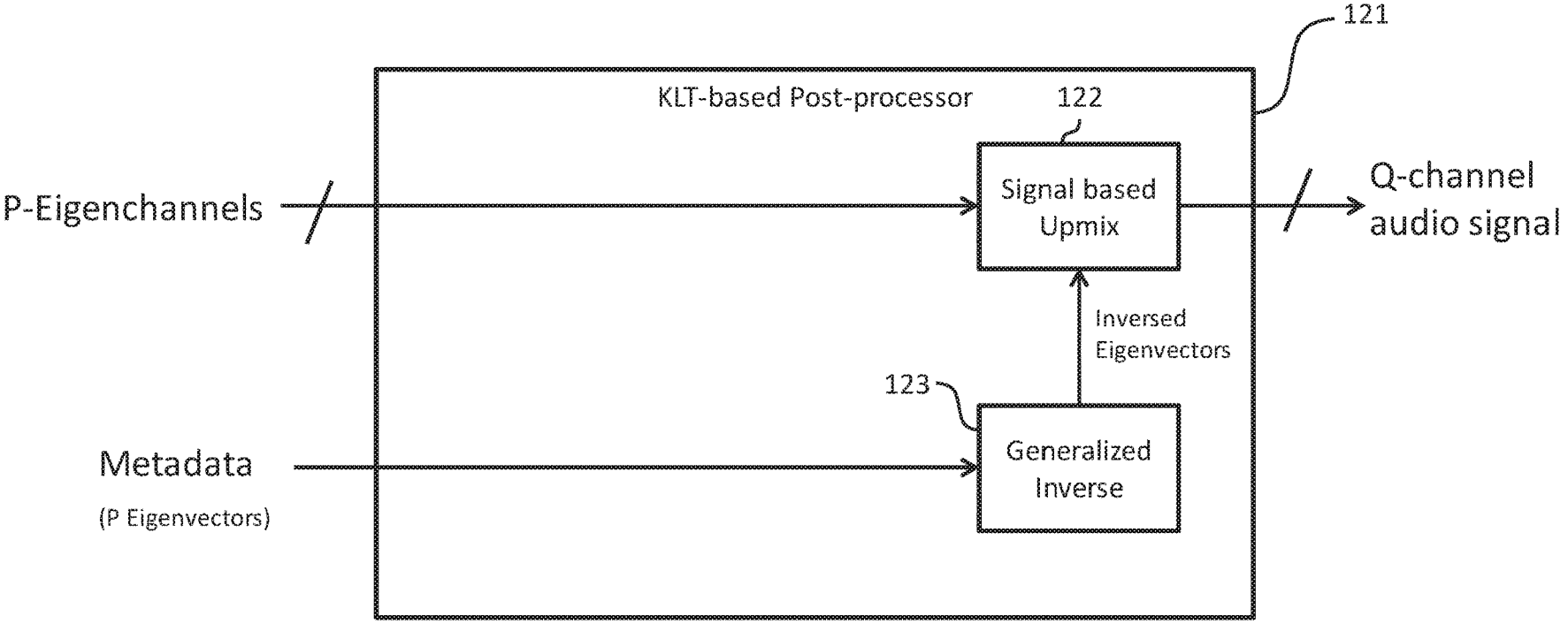
FIG. 4*b* shows a schematic diagram of a KLT-based post-processor of an apparatus for decoding an audio signal according to an embodiment.

FIGS. 4*a* and 4*b* show schematic diagrams of further embodiments of the KLT-based pre-processor 111 of the encoding apparatus 110 and the KLT-based post-processor 121 of the decoding apparatus 120, respectively. The main difference between the embodiments shown in FIGS. 4*a*, 4*b* and the embodiments shown in FIGS. 2*a*, 2*b* is that in the embodiments shown in FIGS. 4*a*, 4*b* the metadata is provided in the form of the P eigenvectors selected by the selector 114, whereas in the embodiments shown in FIGS. 2*a*, 2*b* the metadata is provided in the form of the covariance matrix (or the redundant elements thereof) by the covariance estimation unit 112*a*.

Figure 5:
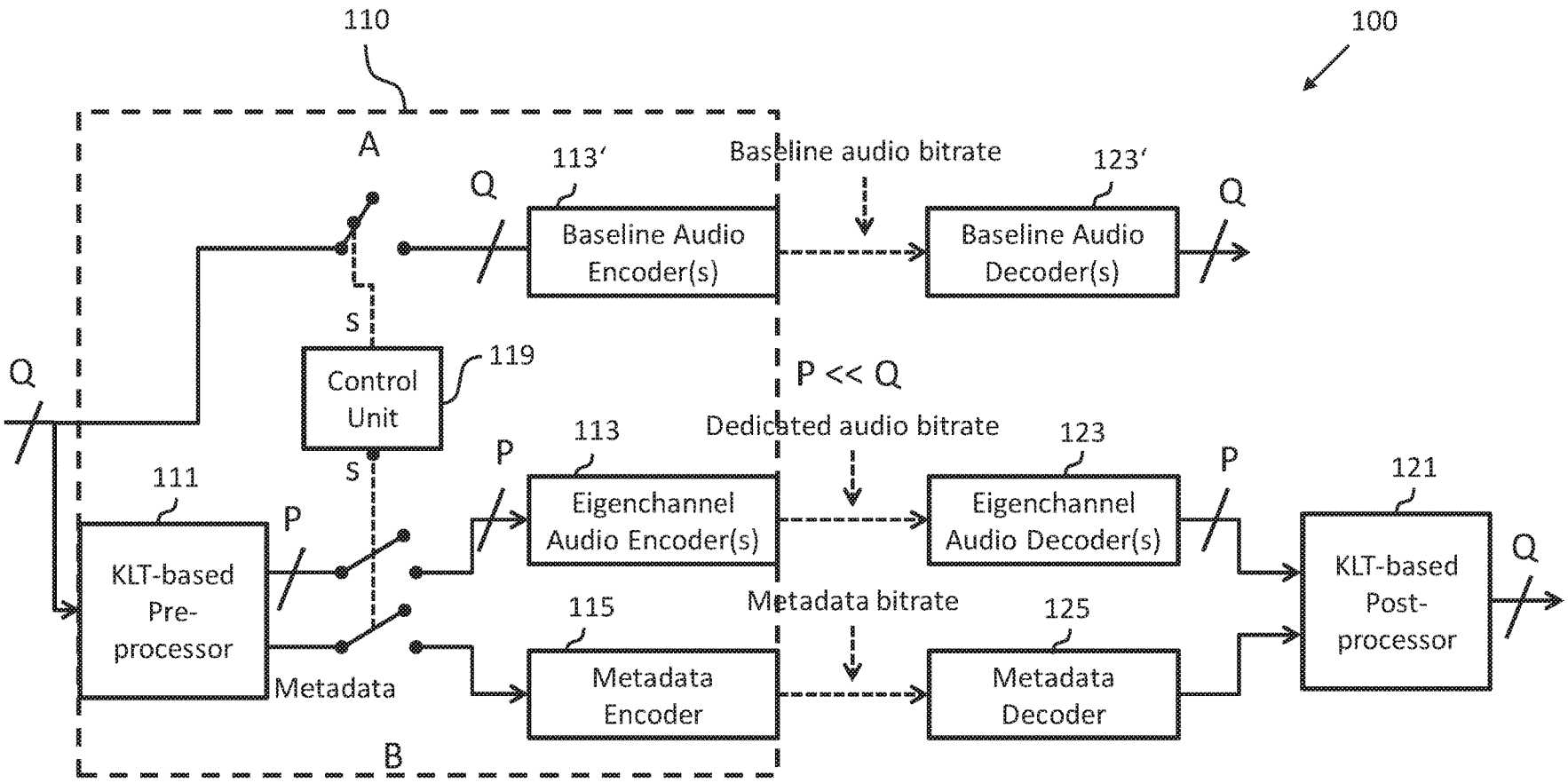
FIG. 5 shows a schematic diagram an audio coding system comprising an apparatus for encoding an audio signal according to an embodiment and an apparatus for decoding the encoded audio signal according to an embodiment.

FIG. 5 shows a schematic diagram of another embodiment of the audio coding system 100 comprising another embodiment of the apparatus 110 for encoding an input audio signal consisting of Q input audio channels. In comparison to the encoding apparatus 110 shown in FIG. 1, the encoding apparatus 110 shown in FIG. 5 further comprises a control unit 119 that is configured to choose or select a first encoding mode or a second encoding mode for encoding the Q input audio channels. In the first encoding mode the Q input audio channels are encoded by the lower branch B of the encoding apparatus 110 (which essentially corresponds to the encoding apparatus 110 shown in FIG. 1), i.e. by encoding the P selected eigenchannels using the eigenchannel encoder 113 and the metadata using the metadata encoder 115. In the second encoding mode the Q input audio channels are simply encoded by an additional baseline encoder 113', which can be based on known audio codecs and provides as output Q encoded input audio channels.

In an embodiment, the control unit 119 is configured to choose on the basis of a pre-defined bitrate threshold between the first encoding mode and the second encoding mode. In an embodiment, the control unit 119 is configured to estimate a bitrate associated with encoding the P selected eigenchannels and the metadata and to choose the first encoding mode if the estimated bitrate is less than the pre-defined bitrate threshold.

More specifically, in the embodiment shown in FIG. 5 the control unit 119 is configured to decide whether the switch "s" is going to the upper branch "A" or the lower branch "B". To this end, the control unit 119 basically can use the information it already has from the configuration of the audio coding system 100 system configuration, such as the number of input audio channels, the maximum transmission rate, i.e. the pre-defined bitrate threshold, the bitrate required by the baseline encoder 113', as well as and the actual number of P plus the metadata bitrate estimate, to make the decision.

In an embodiment, current state of the art encoders, which generally support mono or stereo channels input and are known to deliver excellent audio quality, can be used for the eigenchannel encoder 113 and/or the baseline encoder 113'. Moreover, currently available proprietary multichannel audio codecs can be implemented in the eigenchannel encoder 113 and/or the baseline encoder 113' as well.

For illustrating the control unit 119 of the encoding apparatus 110 shown in FIG. 5 in more detail the following illustrative examples are provided. For this purpose it is assumed that the audio coding system 100 has the following configuration: Q=32 channels, maximum transmission rate (i.e. pre-defined bitrate threshold) of 1.2 Mbps, a mono baseline codec capable of supporting a set of bitrates 8, 16, 24, 32, 48 kbps, wherein 16 kbps delivers an acceptable baseline quality (Quality of Service/QoS guarantee).

In a first scenario the control unit 119 is configured to select the encoding scheme from the first encoding scheme and the second encoding scheme, which provides the best quality, while keeping the overall bitrate below the maximum transmission rate. To this end, the control unit 119, firstly, calculates the baseline maximum bitrate per channel: 1.2 Mbps/32 channels=37.5 kbps per channel. Since this bitrate is not supported, the bitrate of 32 kbps per channel is taken, resulting in 32 kbps*32 channels=1.024 Mbps baseline maximum bitrate. Based on the output of KLT-based pre-processor 111, which outputs the number P as well as metadata bitrate estimates, the control unit 119 calculates the corresponding KLT dedicated audio bitrate per channel: (1.2 Mbps−Metadata bitrate)/P=X Mbps/channel. Thus, in an embodiment the control unit 119 will choose KLT-based encoding (i.e. node B) if X is greater than or equal to the calculated baseline maximum bitrate per channel, i.e., 32 kbps/channel.

In a second scenario the control unit 119 is configured to select the encoding scheme from the first encoding scheme and the second encoding scheme, which provides the lowest possible bitrate achievable given the quality set by the acceptable baseline quality. Firstly, since the lowest acceptable baseline quality bitrate is 16 kbps, the control unit 119 determines the following bitrate: 16 kbps*32 channels=512 kbps baseline maximum bitrate. Based on the output of KLT-based pre-processer 111, which outputs the number P and metadata bitrate estimates, the control unit 119 calculates the corresponding overall KLT-based bitrate: 16 kbps*P+Metadata bitrate=X Mbps/channel. Thus, in an embodiment the control unit 119 will choose KLT-based encoding (i.e. node B) if X is lower than or equal to the calculated baseline maximum bitrate, i.e., 512 kbps.

Figure 6:
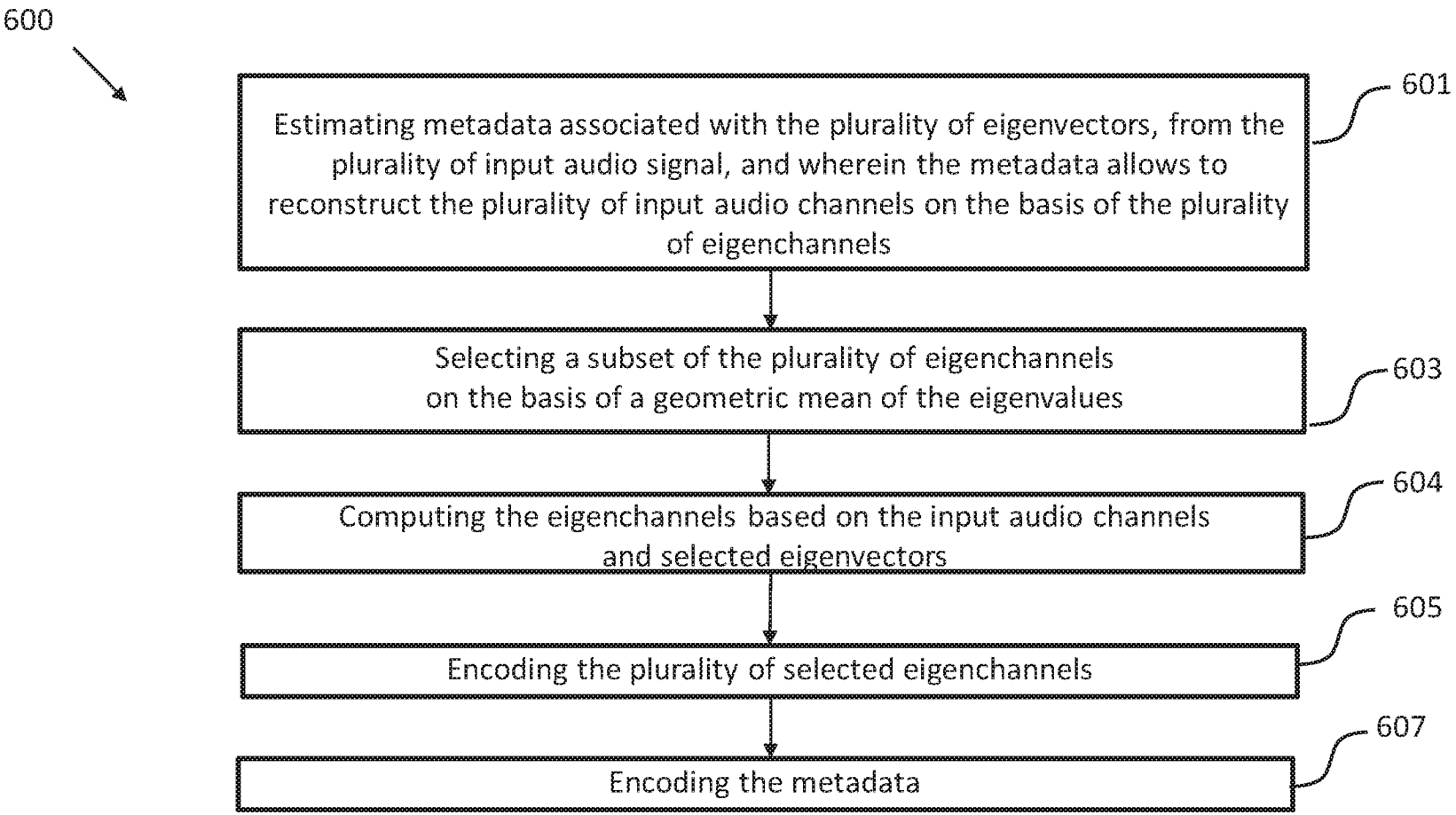
FIG. 6 shows a schematic diagram illustrating a method for encoding a multichannel audio signal according to an embodiment.

FIG. 6 shows a schematic diagram illustrating a method 600 for encoding a multichannel audio signal according to an embodiment. The method 600 comprises a step 601 of estimating metadata associated with the plurality of eigenvectors, from the plurality of input audio channels, wherein each eigenchannel is associated with an eigenvalue and an eigenvector and wherein the metadata allows reconstructing the plurality of input audio channels on the basis of the plurality of eigenchannels; a step 603 of selecting a subset of the plurality of eigenvectors on the basis of a geometric mean of the eigenvalues; a step 604 of computing the eigenchannels based on the input audio channels and selected eigenvectors; a step 605 of encoding the plurality of selected eigenchannels; and a step 607 of encoding the metadata.

Figure 7:
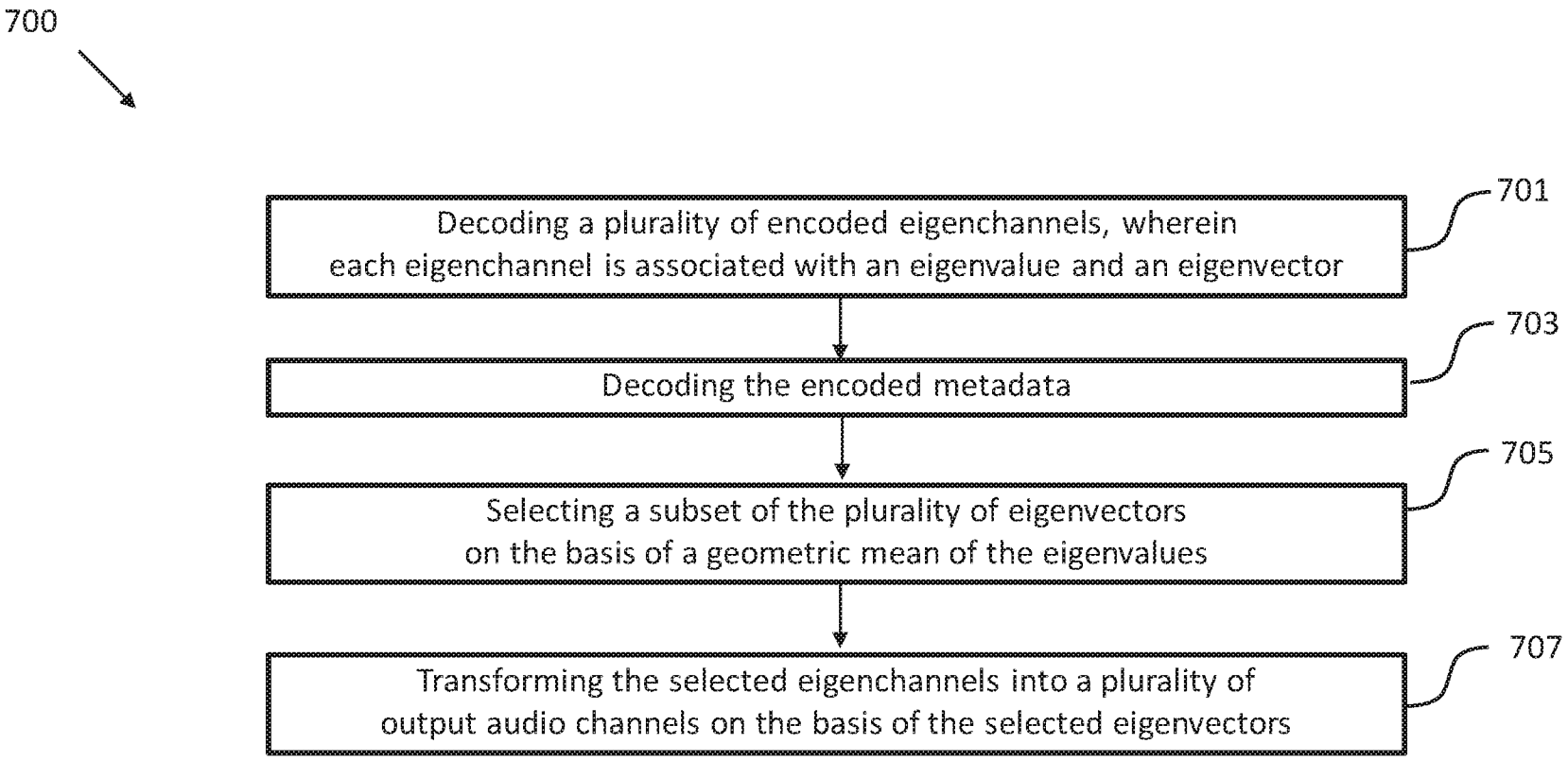
FIG. 7 shows a schematic diagram illustrating a method for decoding a multichannel audio signal according to an embodiment.

FIG. 7 shows a schematic diagram illustrating a method 700 for decoding a multichannel audio signal according to an embodiment. The method 700 comprises a step 701 of decoding the plurality of encoded eigenchannels, wherein each eigenchannel is associated with an eigenvalue and an eigenvector; a step 703 of decoding the encoded metadata; a step 705 of selecting a subset of the plurality of eigenvectors on the basis of a geometric mean of the eigenvalues; and a step 707 of transforming the selected eigenchannels into a plurality of output audio channels on the basis of the selected eigenvectors.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the invention beyond those described herein. While the invention has been described with reference to one or more particular embodiments, those skilled in the art recognize that many changes may be made thereto without departing from the scope of the invention. It is therefore to be understood that within the scope of the appended claims and their equivalents, the invention may be practiced otherwise than as specifically described herein.

What is claimed is:

1. A non-transitory computer readable memory storing instructions that when executed by one or more processors, cause at least the following operations to be performed:

transforming a plurality of input audio channels into a plurality of eigenchannels;

providing metadata associated with the plurality of eigenchannels, wherein each eigenchannel is associated with an eigenvalue and an eigenvector, and wherein the metadata allows reconstructing the plurality of input audio channels on the basis of the plurality of eigenchannels;

selecting a subset of a plurality of eigenvectors associated with the plurality of eigenchannels on the basis of an absolute difference between (i) geometric and (ii) arithmetic means of a plurality of eigenvalues greater than a first threshold value; and encoding the plurality of selected eigenchannels.

2. The non-transitory computer readable memory of claim 1, wherein a number of the plurality of selected eigenchannels is less than or equal to a number of the plurality of input audio channels.

3. The non-transitory computer readable memory of claim 1, wherein the metadata comprises at least one of (i) a covariance matrix associated with the plurality of input audio channels and (ii) eigenvectors of a covariance matrix associated with the plurality of input audio channels.

4. The non-transitory computer readable memory of claim 1, wherein the plurality of input audio signals comprises a plurality of frequency bands.

5. The non-transitory computer readable memory of claim further comprising normalizing the eigenvalues that are greater than the first threshold value on the basis of a smallest eigenvalue that is greater than the first threshold value.

6. The non-transitory computer readable memory of claim 1, further comprising choosing, on the basis of a pre-defined bitrate threshold, between a first encoding mode and a second encoding mode for encoding the plurality of selected eigenchannels, wherein, in the first encoding mode, the input audio signal is encoded by encoding the plurality of selected eigenchannels and the metadata, and wherein, in the second encoding mode, the input audio signal is encoded by encoding the plurality of input audio channels.

7. The non-transitory computer readable memory of claim 6, further comprising:

estimating a bitrate associated with encoding the plurality of selected eigenchannels and the metadata; and choosing the first encoding mode in response to the estimated bitrate being less than the pre-defined bitrate threshold.

8. The non-transitory computer readable memory of claim 1, wherein the one or more processors executing the instructions includes a Karhunen-Loève Transform (KLT) based pre-processor comprises a selector.

9. A non-transitory computer readable memory storing instructions that when executed by one or more processors, cause at least the following operations to be performed:

decoding a plurality of encoded eigenchannels, wherein each eigenchannel is associated with an eigenvalue;

decoding encoded metadata associated with the plurality of encoded eigenchannels;

selecting a subset of the decoded plurality of eigenchannels on the basis of an absolute difference between (i) geometric and (ii) arithmetic means of a plurality of eigenvalues greater than a first threshold value; and transforming the selected decoded eigenchannels into a plurality of output audio channels on the basis of the decoded metadata.

10. The non-transitory computer readable memory of claim 9, wherein a number of the plurality of selected eigenchannels is less than or equal to a number of the plurality of output audio channels.

11. The non-transitory computer readable memory of claim 9, wherein the metadata comprises at least one of: (i) a covariance matrix associated with the plurality of input audio channels and (ii) eigenvectors of a covariance matrix associated with the plurality of input audio channels.

12. The non-transitory computer readable memory of claim 9, wherein the plurality of output audio signals comprises a plurality of frequency bands.

13. A method for encoding an input audio signal comprising a plurality of input audio channels, the method comprising:

estimating, by an apparatus, metadata associated with a plurality of eigenvectors from the plurality of input audio signal, wherein each eigenchannel of the plurality of input audio channels is associated with an eigenvalue and an eigenvector, and wherein the metadata allows reconstructing the plurality of input audio channels on the basis of a plurality of eigenchannels;

selecting, by the apparatus, a subset of the plurality of eigenvectors on the basis of an absolute difference between (i) geometric and (ii) arithmetic means of a plurality of eigenvalues greater than a first threshold value;

determining, by the apparatus, the eigenchannels based on the input audio channels and selected eigenvectors;

encoding, by the apparatus, the plurality of selected eigenchannels; and encoding, by the apparatus, the metadata.

14. The method of claim 13, wherein a number of the plurality of selected eigenchannels is less than or equal to a number of the plurality of input audio channels.

15. The method of claim 13, wherein the metadata comprises at least one of: (i) a covariance matrix associated with the plurality of input audio channels and (ii) eigenvectors of a covariance matrix associated with the plurality of input audio channels.

16. The method of claim 13, wherein the plurality of input audio signals comprises a plurality of frequency bands.

17. The method of claim 13 further comprising normalizing the eigenvalues greater than the first threshold value on the basis of a smallest eigenvalue that is greater than the first threshold value.

18. The method of claim 13, further comprising choosing, by the apparatus and on the basis of a pre-defined bitrate threshold, between first and second encoding modes for encoding the plurality of selected eigenchannels, wherein the first encoding mode encodes the input audio signal by encoding the plurality of selected eigenchannels and the metadata, and wherein the second encoding mode encodes the input audio signal by encoding the plurality of input audio channels.

19. The method of claim 18 further comprising:

estimating, by the apparatus, a bitrate associated with encoding the plurality of selected eigenchannels and the metadata; and choosing, by the apparatus, the first encoding mode in response to the estimated bitrate being less than the pre-defined bitrate threshold.

20. A method for decoding an input audio signal comprising a plurality of encoded eigenchannels and encoded metadata, the method comprising:

decoding, by an apparatus, the plurality of encoded eigenchannels, wherein each eigenchannel is associated with an eigenvalue and an eigenvector;

decoding, by the apparatus, the encoded metadata associated with the plurality of encoded eigenchannels;

selecting, by the apparatus, a subset of the decoded plurality of eigenchannels on the basis of an absolute difference between (i) geometric and (ii) arithmetic means of a plurality of eigenvalues greater than a first threshold value; and transforming, by the apparatus, the selected decoded eigenchannels into a plurality of output audio channels on the basis of the decoded metadata.

21. The method of claim 20, wherein a number of the plurality of selected eigenchannels is less than or equal to a number of the plurality of output audio channels.

22. The method of claim 20, wherein the metadata comprises at least one of: (i) a covariance matrix associated with the plurality of input audio channels and (ii) eigenvectors of a covariance matrix associated with the plurality of input audio channels.

23. The method of claim 20, wherein the plurality of output audio signals comprises a plurality of frequency bands.

* * * * *